US010879604B2

(12) United States Patent
Zhang et al.

(10) Patent No.: US 10,879,604 B2
(45) Date of Patent: Dec. 29, 2020

(54) RADIO-FREQUENCY SIGNAL GROUNDING DEVICE AND ANTENNA

(71) Applicant: CommScope Technologies LLC, Hickory, NC (US)

(72) Inventors: Xun Zhang, Suzhou (CN); Ligang Wu, Suzhou (CN); Bo Wu, Suzhou (CN); Xiaotuo Wang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/583,474

(22) Filed: Sep. 26, 2019

(65) Prior Publication Data

US 2020/0136246 A1 Apr. 30, 2020

(30) Foreign Application Priority Data

Oct. 29, 2018 (CN) ..... 2018 1 1263908

(51) Int. Cl.
*H01Q 1/48* (2006.01)
*H01P 3/08* (2006.01)
*H01Q 15/14* (2006.01)

(52) U.S. Cl.
CPC ..... *H01Q 1/48* (2013.01); *H01P 3/08* (2013.01); *H01Q 15/14* (2013.01)

(58) Field of Classification Search
CPC ..... H01Q 1/48; H01Q 15/0006; H01Q 15/14; H01P 3/08; H01P 1/2007
See application file for complete search history.

(56) References Cited

U.S. PATENT DOCUMENTS

2012/0194290 A1* 8/2012 Wu ..... H01P 3/026 333/12

* cited by examiner

*Primary Examiner* — Hoang V Nguyen
(74) *Attorney, Agent, or Firm* — Myers Bigel, P.A.

(57) ABSTRACT

A radio-frequency signal grounding device for an antenna comprises: a substrate layer; a grounding transmission line on a first side of the substrate layer; a metal layer on a second side of the substrate layer, the metal layer including at least one gap such that the metal layer is divided into at least a first sub-region and a second sub-region, where the gap is configured to block at least one of a low frequency signal and a direct current signal; a metal plate; and a dielectric layer that is disposed between the metal plate and the metal layer. The radio-frequency signal grounding device can achieve good radio-frequency signal grounding and low frequency/direct current signal blocking within a limited space via a multi-coupling design.

18 Claims, 4 Drawing Sheets

RADIO-FREQUENCY SIGNAL GROUNDING DEVICE AND ANTENNA

CROSS-REFERENCE TO RELATED APPLICATION

The present application claims priority to Chinese Patent Application Serial No. 201811263908.6, filed Oct. 29, 2018, the entire content of which is incorporated herein by reference.

FIELD

The present invention relates to radio-frequency (RF) signal grounding devices for antennas. Further, the present invention relates to an antenna having a radio-frequency (RF) signal grounding devices.

BACKGROUND

In antenna systems such as antenna systems for cellular communications systems, various signals such as RF signals, low frequency control signals and/or direct current signals may be transmitted on the same transmission line. The RF signals typically are the signals transmitted and received by the antenna system. The low frequency signals typically are control signals, such as, for example, control signals for a remote electronic downtilt (RET) device. The direct current signals may be one or more power signals that are used to power components within the antenna.

In order to prevent the low frequency signals and/or the direct current signals from being grounded when the RF signals are grounded, an isolation circuit may be provided that isolates the low frequency signals and the direct current signals from the RF signals. At present, a common implementation of the isolation circuit is providing a stub to ground along the transmission line that suppresses the low frequency and direct current signals while allowing the RF signals to pass. However, such stub isolation circuits may have a narrow bandwidth, may occupy a large area on a printed circuit board, and may be expensive.

SUMMARY

The present invention provides an RF signal grounding device for an antenna comprising: a substrate layer; a grounding transmission line on a first side of the substrate layer. The RF signal grounding device further includes: a metal layer on a second side of the substrate layer, the metal layer including at least one gap such that the metal layer is divided into at least a first sub-region and a second sub-region, wherein the gap is configured to block at least one of a low frequency signal and a direct current signal; and a metal plate, wherein a dielectric layer is disposed between the metal plate and the metal layer.

In some embodiments, the dielectric layer comprises a solder mask layer and/or air.

In some embodiments, the metal layer has two or more gaps such that the metal layer is divided into a first sub-region, a second sub-region, and one or more additional regions, the first sub-region and the second sub-region being spaced apart from one another by the one or more additional regions.

In the present invention, the sub-region that is electrically connected to an upstream transmission line, such as an inner conductor of a coaxial cable via the grounding transmission line is referred to as a "first sub-region", and the sub-region that is electrically connected to an upstream transmission line, such as an outer conductor of the coaxial cable is referred to as a "second sub-region". In the case where the metal layer has a plurality of gaps, additional sub-regions such as a third sub-region, a fourth sub-region and the like, may also be present between the first sub-region and the second sub-region.

In some embodiments, the grounding transmission line is electrically connected to the first sub-region through the substrate layer.

In some embodiments, the substrate layer is provided with at least one conductive via hole, wherein the grounding transmission line is electrically connected to the first sub-region via the conductive via hole. The conductive via hole is also referred to as metallization hole. In a double-sided PCB and a multilayer PCB, the via hole is provided to connect printed wirings on different layers with each other. According to the present invention, the grounding transmission line may be electrically connected to the first sub-region on the copper layer via the via hole, so that signals may be directed to the copper layer from the transmission line to achieve grounding of the radio-frequency signals.

In some embodiments, the metal layer is a copper layer.

In some embodiments, the first sub-region is configured as a polygonal region or a region with a circular arc.

In some embodiments, the first sub-region is configured as a rectangular region, a triangular region, a hexagonal region or an octagonal region.

In some embodiments, the gap is filled with air.

In some embodiments, the gap is completely or partly filled with solid dielectric materials.

In some embodiments, the substrate layer is a paper substrate, a glass fiber fabric substrate, or a composite substrate.

In some embodiments, the substrate layer of the PCB may be constructed as a glass fiber fabric substrate (FR-4). Of course, other types of substrates such as a paper substrate (FR-1, FR-2), a composite substrate (CEM series), or a substrate of special materials (ceramic, metal base, etc.) may also be used for the substrate layer of the PCB.

In some embodiments, the area of the first sub-region, the thickness of the metal layer and/or the width of the gap are selected based on a frequency range of the RF signal.

In some embodiments, the thickness of the metal layer is between 0.02 mm and 0.3 mm.

In some embodiments, the width of the gap is between 0.01 mm and 1 mm.

In some embodiments, the metal plate is a reflector of the antenna.

In some embodiments, the metal plate is connected to the metal layer only via the solder mask layer. Therefore, the coupling between the metal layer and the metal plate can be improved in a simple manner.

The present invention further provides an radio-frequency signal grounding device for an antenna comprising: a printed circuit board that includes a dielectric substrate, a grounding transmission line on a first major surface of the dielectric substrate and a metal pattern having a first region on a second major surface of the dielectric substrate; wherein the first region is capacitively coupled to a grounded element of the antenna.

In some embodiments, the printed circuit board includes a conductive that electrically connects the grounding transmission line to the first region of the metal pattern.

In some embodiments, the metal pattern further includes a second region on a second major surface of the dielectric substrate that is capacitively coupled to the first region.

In some embodiments, the first region is capacitively coupled to the grounded element via a first capacitive connection to the second region and via a second capacitive connection to the grounded element.

Further, the present invention provides an antenna, which has at least one radio-frequency signal grounding device according to one of embodiments of the present invention.

DETAILED DESCRIPTION

Figure 1A:
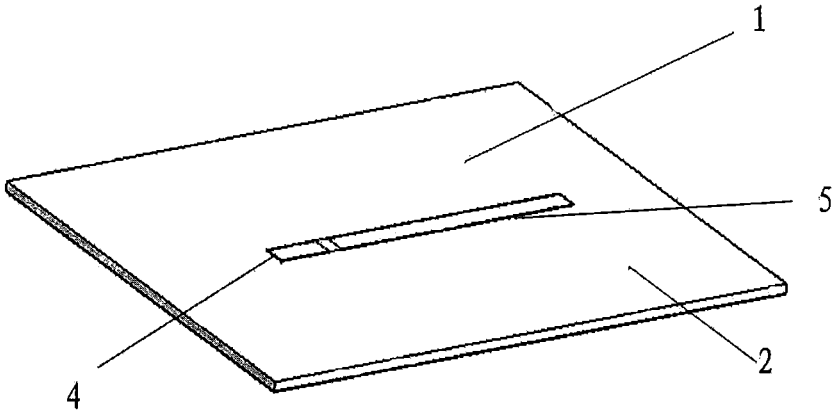
FIG. 1*a* is a schematic perspective view of a conventional RF signal grounding device.

Embodiments of the present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It should also be understood that, the embodiments disclosed herein can be combined in various ways to provide many additional embodiments.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the listed items.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs present the same elements. In the drawings, for the sake of clarity, the sizes of certain features may be modified.

In antenna systems, various signals such as RF signals, low frequency control signals and/or direct current power signals may be transmitted on the same transmission line. The RF signals may be signals that are transmitted or received by the antenna system, and can include signals in multiple different RF frequency bands. The low frequency signals typically are control signals such as signals that control a RET device. The frequency range of the low frequency signals (such as AISG signals) may be between 1 MHz to 5 MHz. In other embodiments, the frequency range of the low frequency signals may be smaller than 1 MHz or larger than 5 MHz. The direct current signals are typically DC power signals that power electronic and/or electromechanical elements within the antenna. Since the RF signals and the low frequency/direct current signals have different functions, it is necessary to process them separately. For example, when the RF signals are grounded, the low frequency and direct current signals typically should not be grounded, as doing so could prevent the control signals from reaching the RET device and/or cut off DC power to systems within the antenna such as, for example, a controller, the RET device, etc.

Figure 1B:
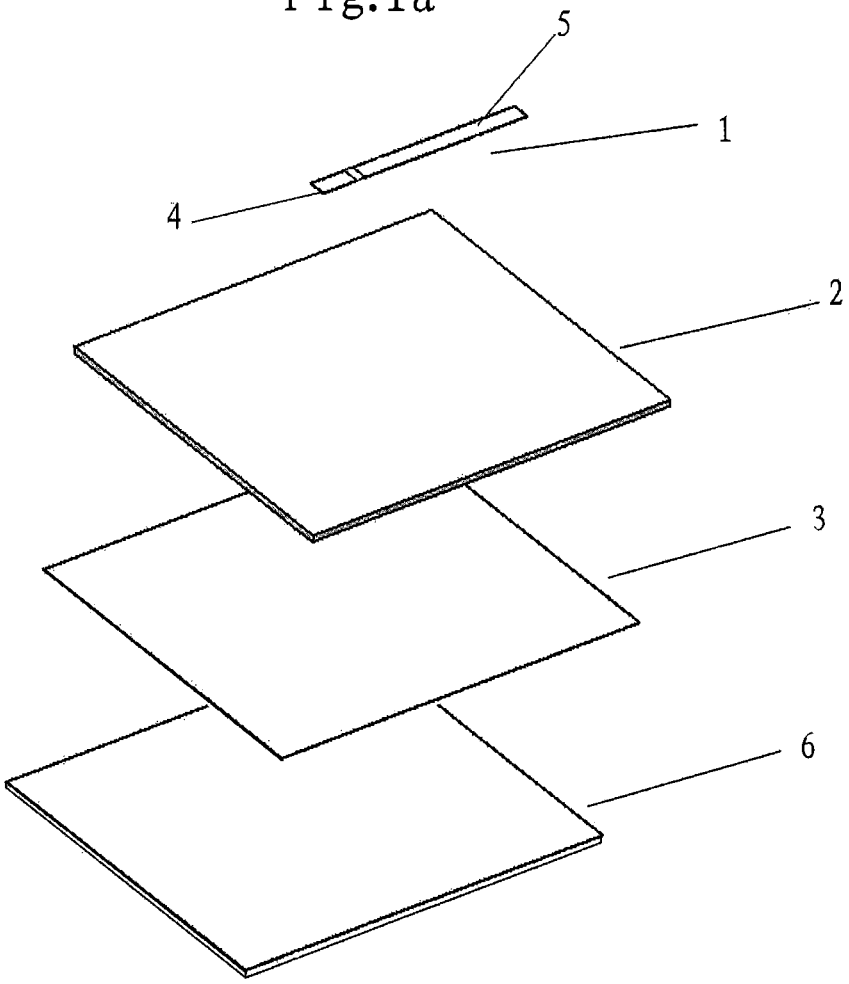
FIG. 1*b* is a schematic exploded perspective view of the conventional RF signal grounding device of FIG. 1*a*.

Referring now to FIGS. 1*a* and 1*b*, a schematic view and an exploded schematic view of a conventional RF signal grounding device are shown respectively. As shown in FIGS. 1*a* and 1*b*, the RF signal grounding device comprises a grounding transmission line 1, a substrate layer 2, a copper layer 3 and a metal plate 6. The grounding transmission line 1 is disposed on the substrate layer 2, the copper layer 3 is disposed underneath the substrate layer 2, and the metal plate 6 is disposed underneath the copper layer 3. In the present example, the metal plate 6 may be a reflector of the antenna.

The grounding transmission line 1 has a signal input end 4, which directs signals (such as low frequency and direct current signals and RF signals) from an upstream transmission line (not shown) to the grounding transmission line 1. The grounding transmission line 1 transmits the RF signals to the copper layer 3 to ground the RF signals. In order to prevent the low frequency and direct current signals from being grounded, the grounding transmission line 1 is provided with a stub 5. It has been known that the input impedance of the stub is purely reactive in the case of ignoring the loss of the grounding transmission line, and whether the stub is capacitive or inductive depends on the electrical length of the stub and on whether the stub is open-circuited or short-circuited. In order to block the low frequency and direct current signals from being grounded via the grounding transmission line 1, the stub 5 may be constructed as a quarter-wavelength open stub having capacitive characteristics. The stub may have a length that is a quarter wavelength of the center frequency of the operating frequency band of the RF signals.

However, the RF signal grounding device of FIGS. 1*a*-1*b* has at least two disadvantages. First, the quarter-wavelength open stub has a narrow bandwidth, since its actual length is designed only for a specific frequency point, such as the center frequency point of the operating frequency band of the RF signals. Second, the quarter-wavelength open stub occupies a relatively large wiring space.

Figure 2A:
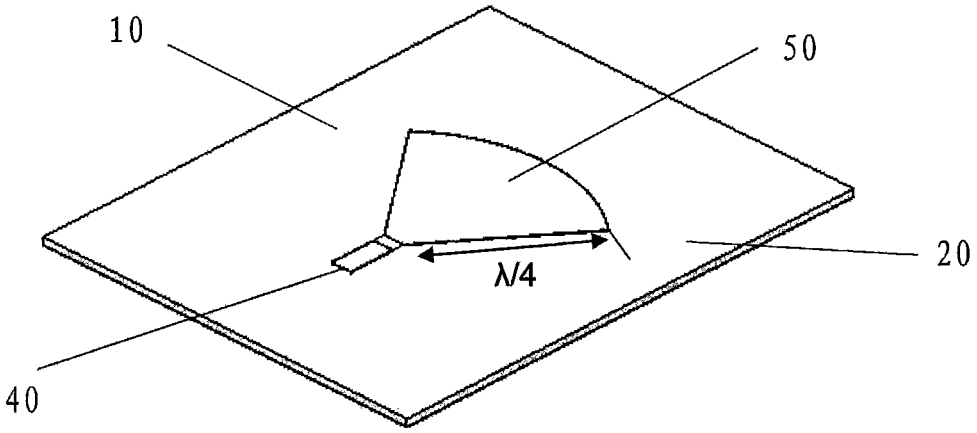
FIG. 2*a* is a schematic perspective view of another conventional RF signal grounding device.
Figure 2B:
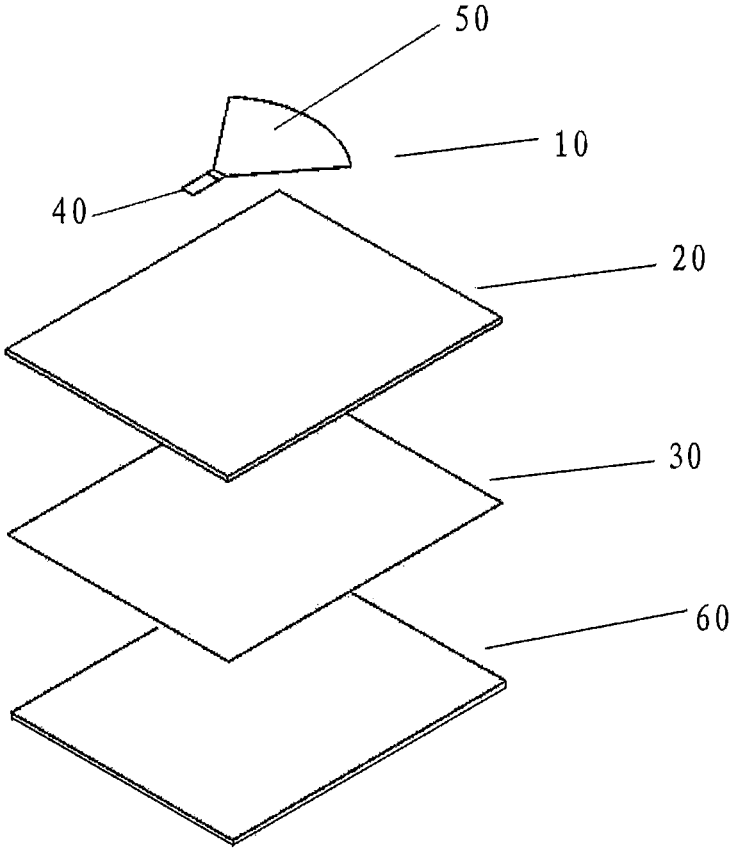
FIG. 2*b* is a schematic exploded perspective view of the conventional RF signal grounding device of FIG. 2*a*.

FIGS. 2*a* and 2*b* are a schematic view and an exploded schematic view of another conventional RF signal grounding device. As shown in FIGS. 2*a* and 2*b*, this RF signal grounding device comprises a grounding transmission line 10, a substrate layer 20, a copper layer 30 and a metal plate 60. The grounding transmission line 10 is disposed on the substrate layer 20, the copper layer 30 is disposed underneath the substrate layer 20, and the metal plate 60 is disposed underneath the copper layer 30. In the present example, the metal plate 60 may be a reflector of the antenna. Further, the grounding transmission line 10 has a signal input end 40, which directs signals from an upstream transmission line (not shown) to the grounding transmission line 10 to achieve grounding of the RF signals.

In contrast to the RF signal grounding device of FIGS. 1*a* and 1*b*, the grounding transmission line 10 in the RF signal grounding device of FIGS. 2*a*-2*b* is implemented as a radial stub 50, which has a radius of a quarter wavelength. Compared with the quarter-wavelength open stub, the radial stub 50 has a wider bandwidth. However, the radial stub 50 requires a larger wiring space.

Figure 3A:
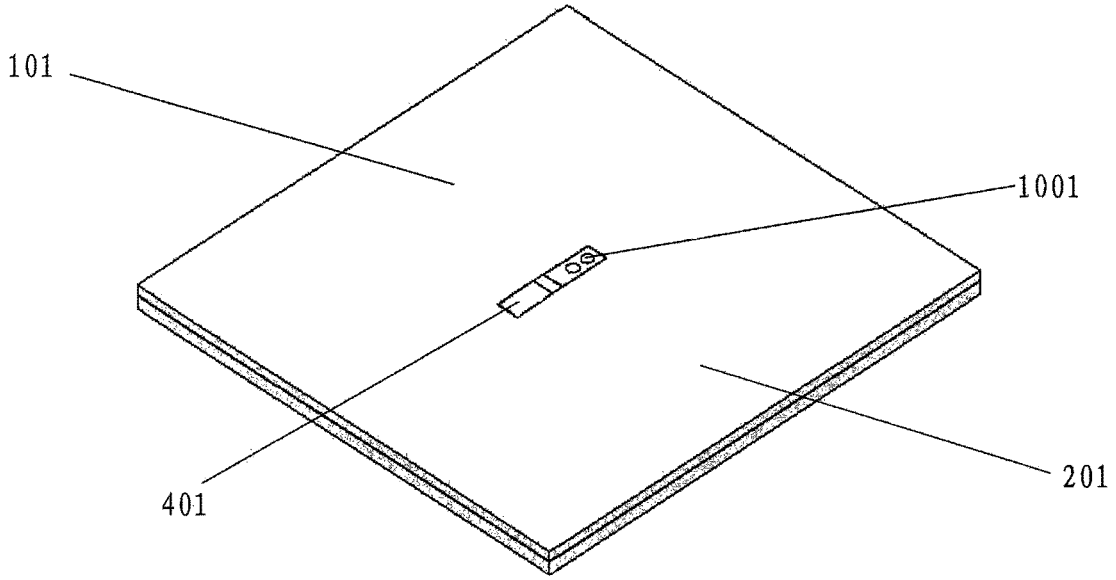
FIG. 3*a* a schematic perspective view of an RF signal grounding device according to a first embodiment of the present invention.
Figure 3B:
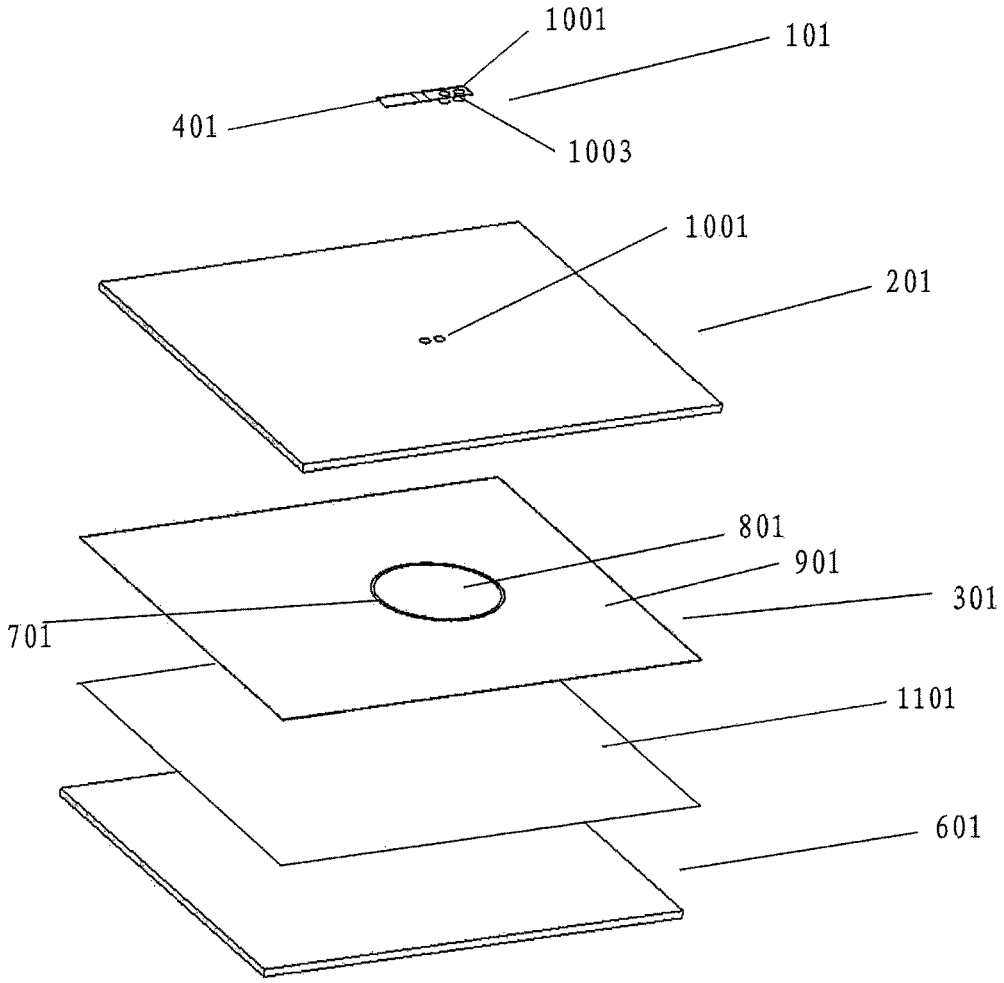
FIG. 3*b* is an schematic exploded perspective view of the RF signal grounding device of FIG. 3*a*.

Referring now to FIGS. 3*a* and 3*b*, a schematic view and an exploded schematic view of an RF signal grounding device according to a first embodiment of the present invention are shown respectively. As shown in FIGS. 3*a* and 3*b*, this RF signal grounding device comprises a grounding transmission line 101, a substrate layer 201, a copper layer 301 and a metal plate 601. The copper layer 301 and the metal plate 601 may be spaced apart from one another by a solder mask layer 1101. The grounding transmission line 101 is disposed on the substrate layer 201, the copper layer 301 is disposed underneath the substrate layer 201, and the metal plate 601 is disposed underneath the copper layer 301. Therefore, the substrate layer 201 serves as a dielectric layer between the grounding transmission line 101 and the copper layer 301. The substrate layer 201 may be a paper substrate, a glass fiber fabric substrate, a composite substrate or the like. In the present example, the metal plate 601 may be a reflector of the antenna.

As can be seen from FIGS. 3*a* and 3*b*, the grounding transmission line 101 has a signal input end 401, which directs signals from an upstream transmission line (not shown) to the grounding transmission line 101 to achieve grounding of the RF signals. Further, the grounding transmission line 101 and the substrate layer 201 are provided with two via holes (also referred to as metallization holes) respectively, which electrically connect the grounding transmission line 101 and the copper layer 301 via the printed wirings 1003. It may be appreciated that one or more than two via holes (e. g., three or four via holes) may be provided in other embodiments.

As can be seen from the FIGS. 3*a* and 3*b*, the copper layer 301 has an annular gap 701 thereon, which divides the copper layer 301 into a circular first sub-region 801 and a second sub-region 901 surrounding the first sub-region 801. The first sub-region 801 and the second sub-region 901 are spaced apart from one another by the annular gap 701, thereby forming a capacitor. Further, the first sub-region 801 is spaced apart from the metal plate 601 by the solder mask layer 1101. The first sub-region 801 may be closely spaced apart from the metal plate 601, with only the thin solder mask layer 1101 therebetween, thereby forming another capacitor. Thus, the coupling between the first sub-region 801 and the metal plate 601 may be improved in a simple manner. In other embodiments, it is also possible that the first sub-region 801 is spaced apart from the metal plate 601 by the solder mask layer and/or air. This multi-coupling design is advantageous, realizing good RF signal grounding and low frequency/direct current signal blocking within a limited space.

The first sub-region 801 and the second sub-region 901 may form the two electrodes of a capacitor, and the annular gap 701 may act as the dielectric of the capacitor. The side area of a cylinder formed by the first sub-region 801 may be equivalent to the effective overlap area of the capacitor, and the width of the gap 701 may be equivalent to a distance between the two electrodes of the capacitor. Thus, in order to adjust the capacitance of the capacitor, a thickness of the copper layer 301 may be increased or decreased, or an area of the first sub-region 801 may be increased to thereby increase the effective overlap area. In addition, a dielectric material (other than air) may also be filled or partly filled in the gap 701.

Similarly, the first sub-region 801 and the metal plate 601 may form the two electrodes of a second capacitor. A solder mask and/or air between them may act as the dielectric of the second capacitor. Therefore, in order to adjust the capacitance of the second capacitor, the area of the first sub-region 801 may be increased or decreased to thereby increase or decrease the effective overlap area. In addition, other dielectric materials may be filled or partially filled between the first sub-region 801 and the metal plate 601.

In order to achieve grounding of the RF signals while preventing the low frequency and/or direct current signals from being grounded, the upstream transmission line, such as an inner conductor of a coaxial cable is electrically connected to the signal input end 401 of the grounding transmission line 101, so as to directs signals (such as RF signals, low frequency signals and/or direct current signals) to the grounding transmission line 101. Further, an outer conductor of the coaxial cable is electrically connected to the second sub-region 901 of the copper layer 301, thus the transmission loop of the DC signals and low frequency signals is cut off due to the gap 701. As can be seen from FIG. 3*b*, the grounding transmission line 101 is electrically connected to the first sub-region 801 via a via hole 1001 and is spaced apart from the second sub-region 901 by the gap 701. In addition, the first sub-region 801 and the metal plate 601 may be separated from one another by the solder mask layer 1101 and/or air. In this way, the RF signals can pass from the grounding transmission line 101 through the substrate layer 201 via the via hole 1001 to the first sub-region 801, and then from the first sub-region 801 to the second sub-region 901 via the gap 701, and the RF signals can pass from the first sub-region 801 to the metal plate 601 via the solder mask layer 1101 and/or air, thereby achieving grounding of the RF signals. In contrast, although the low frequency and direct current signals can pass from the grounding transmission line 101 through the substrate layer 201 via the via hole 1001 to the first sub-region 801, they are unable to pass from the first sub-region 801 to the second sub-region 901 via the gap 701 or to the metal plate 601 via the solder mask layer 1101 and/or air. Accordingly, the low frequency and direct current signals will not be grounded.

In this embodiment, the thickness of the copper layer 301 may be between 0.02 mm and 0.3 mm. Of course, it may also be less than 0.02 mm or more than 0.3 mm in other embodiments, and the thickness of the copper layer 302 may be selected according to the characteristics of the RF signals and processing technology. Also, in this embodiment, the width of the gap 701 is between 0.02 mm and 1 mm. Of course, it may also be less than 0.02 mm or more than 1 mm in other embodiments, and the width of the gap 701 may be selected according to the characteristics of the RF signals and processing technology.

The RF signal grounding device according to the first embodiment of the present invention may have several advantages over the above-described conventional RF signal grounding devices. First, the RF signal grounding device may require less wiring space, since there is no need to provide a direct current-blocking stub (e. g., stubs 5 and 50) on the wiring layer that includes the grounding transmission line 101. Second, the RF signal grounding device has a wide bandwidth because its characteristic is not designed for a specific frequency point. Third, the RF signal grounding device can achieve good RF signal grounding performance within a limited space based on the multi-coupling grounding design. Fourth, the RF signal grounding device has a simple structure, is easy to operate, and is inexpensive to manufacture.

Figure 4:
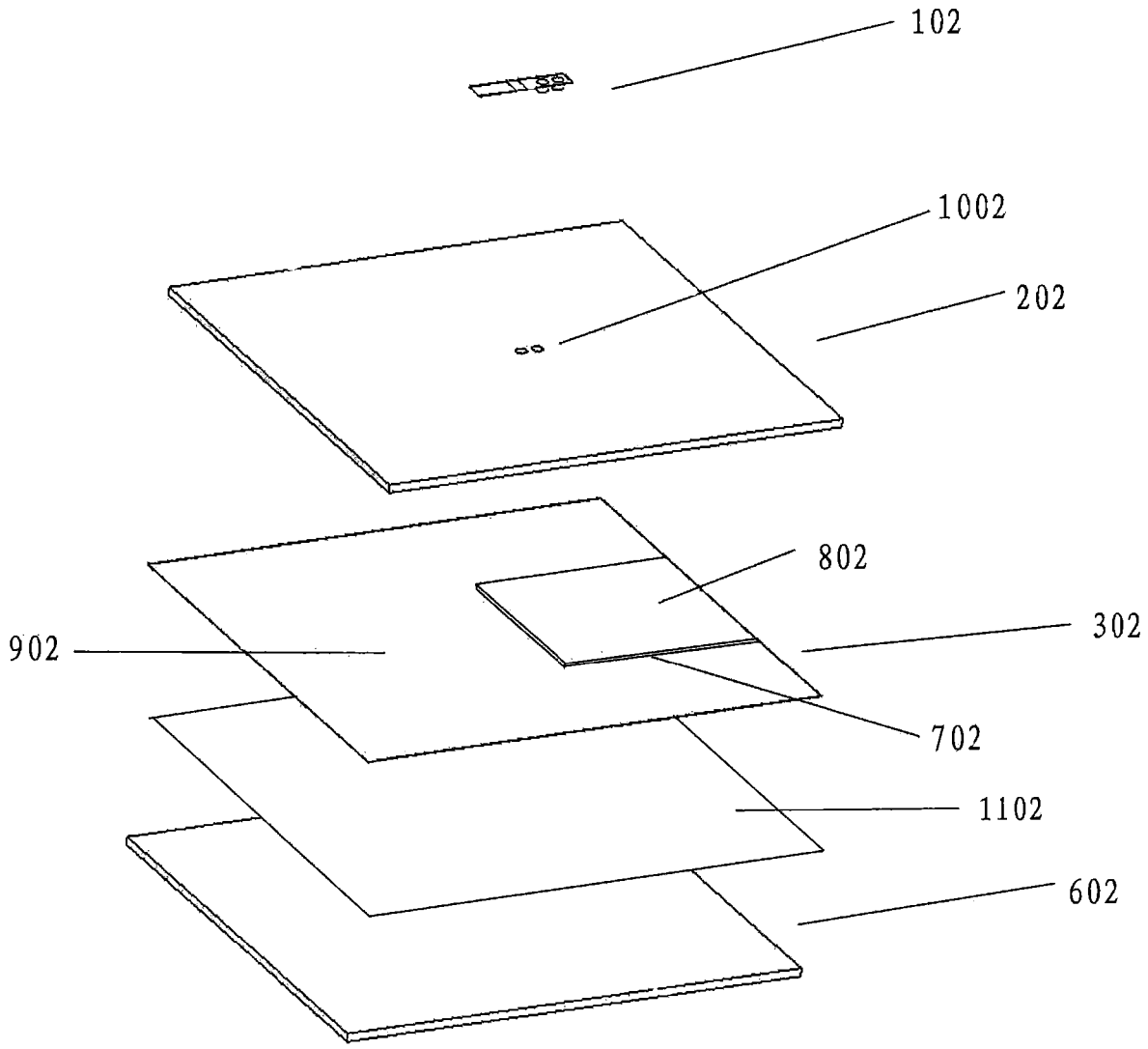
FIG. 4 is a schematic exploded perspective view of an RF signal grounding device according to a second embodiment of the present invention.

Referring now to FIG. 4, an exploded schematic view of an RF signal grounding device according to a second embodiment of the present invention is shown. As shown in FIG. 4, the RF signal grounding device comprises a grounding transmission line 102, a substrate layer 202, a copper layer 302 and a metal plate 602.

Only differences from the first embodiment will be described herein. As can be seen from FIG. 4, the copper layer 302 has a gap 702 thereon, which divides the copper layer 302 into a first sub-region 802 on the edge of the copper layer 302 and a second sub-region 902 surrounding the first sub-region 802. The first sub-region 802 is formed into a rectangular region together with one side of the copper layer 302.

In order to achieve grounding of RF signals while preventing low frequency and direct current signals from being grounded, the grounding transmission line 102 is electrically connected to the first sub-region 802 via a via hole 1002 and is spaced apart from the second sub-region 902 by the gap 702. In addition, the first sub-region 802 and the metal plate 602 may be separated from one another by the solder mask layer and/or air. In this manner, the RF signals can pass from the grounding transmission line 102 through the substrate layer 202 via the via hole 1002 to the first sub-region 802, and then from the first sub-region 802 to the second sub-region 902 via the gap 702, and the RF signals can pass from the first sub-region 802 to the metal plate 602 via the solder mask layer and/or air, thereby achieving grounding of RF signals without grounding the low frequency and direct current signals.

In other embodiments, the first sub-region may be configured as a polygonal region or a region with a circular arc. For example, the first sub-region may be configured as a triangular region, a hexagonal region or an octagonal region in other example embodiments.

In other embodiments, more gaps may be provided to divide the copper layer into more sub-regions. For example, other sub-regions may also be provided between the first sub-region and the second sub-region.

In other embodiments, the number, area, shape, and the like of the first sub-region and the second sub-region may be set arbitrarily. For example, four first sub-regions and two second sub-regions may be provided respectively.

As shown in FIGS. 3*a*-4, pursuant to embodiments of the present invention, the RF signal grounding devices according to embodiments of the present invention may be formed on printed circuit boards. The RF signal grounding devices include a grounding transmission line on a first major surface of the printed circuit board and a metal pattern having a first region and a second region on a second major surface of the printed circuit board. The grounding transmission line may be electrically connected to the first region and the first region may be capacitively coupled to the second region. The electrical connection between the grounding transmission line and the first region may comprise one or more conductive vias that extend between the grounding transmission line and the first region through a dielectric substrate of the printed circuit board. The capacitive connection between the first region and the second region may be an edge capacitive connection. The first region and/or the second region may be capacitively coupled to a grounded element such as, for example, a reflector of the antenna.

Although the exemplary embodiments of the present invention have been described, a person skilled in the art should understand that, multiple changes and modifications may be made to the exemplary embodiments without substantively departing from the spirit and scope of the present invention. Accordingly, all the changes and modifications are encompassed within the protection scope of the present invention as defined by the claims. The present invention is defined by the appended claims, and the equivalents of these claims are also contained therein.

That which is claimed is:

1. A radio frequency ("RF") signal grounding device for an antenna comprising:

a substrate layer;

a grounding transmission line on a first side of the substrate layer;

a metal layer on a second side of the substrate layer, the metal layer including at least one gap such that the metal layer is divided into at least a first sub-region and a second sub-region, wherein the gap is configured to block at least one of a low frequency signal and a direct current signal;

a metal plate; and a dielectric layer that is disposed between the metal plate and the metal layer, wherein the grounding transmission line is electrically connected to the first sub-region through the substrate layer.

2. The RF signal grounding device for an antenna according to claim 1, wherein the dielectric layer comprises a solder mask layer and/or air.

3. The RF signal grounding device for an antenna according to claim 1, wherein the substrate layer is provided with at least one conductive via hole, and the grounding transmission line is electrically connected to the first sub-region via the conductive via hole.

4. The RF signal grounding device for an antenna according to claim 1, wherein the metal layer is a copper layer.

5. The RF signal grounding device for an antenna according to claim 1, wherein the first sub-region is configured as a polygonal region or a region with a circular arc.

6. The RF signal grounding device for an antenna according to claim 5, wherein the first sub-region is configured as a rectangular region, a triangular region, a hexagonal region or an octagonal region.

7. The RF signal grounding device for an antenna according to claim 1, wherein the gap is filled with air.

8. The RF signal grounding device for an antenna according to claim 7, wherein the gap is completely or partly filled with solid dielectric materials.

9. The RF signal grounding device for an antenna according to claim 1, wherein the substrate layer is a paper substrate, a glass fiber fabric substrate, or a composite substrate.

10. The RF signal grounding device for an antenna according to claim 1, wherein the area of the first sub-region, the thickness of the metal layer and/or the width of the gap are selected based on a frequency range of the RF signal.

11. The RF signal grounding device for an antenna according to claim 10, wherein the thickness of the metal layer is between 0.02 mm and 0.3 mm.

12. The RF signal grounding device for an antenna according to claim 10, wherein the width of the gap is between 0.01 mm and 1 mm.

13. The RF signal grounding device for an antenna according to claim 1, wherein the metal plate is a reflector of the antenna.

14. A radio frequency ("RF") signal grounding device for an antenna comprising:

a substrate layer;

a grounding transmission line on a first side of the substrate layer;

a metal layer on a second side of the substrate layer, the metal layer including at least one gap such that the metal layer is divided into at least a first sub-region and a second sub-region, wherein the gap is configured to block at least one of a low frequency signal and a direct current signal;

a metal plate; and a dielectric layer that is disposed between the metal plate and the metal layer, wherein the metal layer has two or more gaps such that the metal layer is divided into a first sub-region, a second sub-region, and one or more additional regions, the first sub-region and the second sub-region being spaced apart from one another by the one or more additional regions.

15. A radio frequency ("RF") signal grounding device for an antenna comprising:

a substrate layer;

a grounding transmission line on a first side of the substrate layer;

a metal layer on a second side of the substrate layer, the metal layer including at least one gap such that the metal layer is divided into at least a first sub-region and a second sub-region, wherein the gap is configured to block at least one of a low frequency signal and a direct current signal;

a metal plate; and a dielectric layer that is disposed between the metal plate and the metal layer, wherein the metal plate is connected to the metal layer only via the dielectric layer.

16. A radio-frequency (RF) signal grounding device for an antenna comprising:

a printed circuit board that includes a dielectric substrate, a grounding transmission line on a first major surface of the dielectric substrate and a metal pattern having a first region on a second major surface of the dielectric substrate, wherein the first region is capacitively coupled to a grounded element of the antenna, wherein the printed circuit board includes a conductive via that electrically connects the grounding transmission line to the first region of the metal pattern.

17. The RF signal grounding device for an antenna according to claim 16, wherein the metal pattern further includes a second region on a second major surface of the dielectric substrate that is capacitively coupled to the first region.

18. The RF signal grounding device for an antenna according to claim 17, wherein the first region is capacitively coupled to the grounded element via a first capacitive connection to the second region and via a second capacitive connection to the grounded element.

* * * * *